US008622704B2

(12) United States Patent
Stiehler et al.

(10) Patent No.: US 8,622,704 B2
(45) Date of Patent: Jan. 7, 2014

(54) GAS TURBINE BLADE FOR A TURBOMACHINE

(75) Inventors: Frank Stiehler, Bad Liebenwerda (DE); Hans Peter Borufka, Starnberg (DE); Patrick Prokopczuk, Munich (DE)

(73) Assignee: MTU Aero Engines GmbH, Munich (DE)

( * ) Notice: Subject to any disclaimer, the term of this patent is extended or adjusted under 35 U.S.C. 154(b) by 0 days.

(21) Appl. No.: 13/508,875

(22) PCT Filed: Nov. 12, 2010

(86) PCT No.: PCT/DE2010/001334

§ 371 (c)(1), (2), (4) Date: May 9, 2012

(87) PCT Pub. No.: WO2011/057622

PCT Pub. Date: May 19, 2011

(65) Prior Publication Data

US 2012/0230825 A1 Sep. 13, 2012

(30) Foreign Application Priority Data

Nov. 13, 2009 (DE) ..... 10 2009 052 881

(51) Int. Cl.
*F01D 5/18* (2006.01)

(52) U.S. Cl.
USPC ..... 416/146 R; 416/232; 416/231 R; 416/195

(58) Field of Classification Search
USPC ..... 416/146 R, 232, 231 R, 96 R, 97 R, 189, 416/195
See application file for complete search history.

(56) References Cited

U.S. PATENT DOCUMENTS

| | | | | |
|---|---|---|---|---|
| 3,328,867 | A | 7/1967 | Guengant | |
| 3,572,968 | A | 3/1971 | Musick et al. | |
| 3,626,568 | A * | 12/1971 | Silverstein et al. | 29/889.72 |
| 4,136,516 | A * | 1/1979 | Corsmeier | 60/39.091 |
| 5,393,200 | A | 2/1995 | Dinh et al. | |
| 6,158,104 | A | 12/2000 | Roberts et al. | |
| 6,883,700 | B2 * | 4/2005 | Kottilingam et al. | 228/119 |
| 7,077,622 | B2 * | 7/2006 | Ehrhard et al. | 415/9 |
| 2009/0116964 | A1 | 5/2009 | Brock | |
| 2009/0313822 | A1 * | 12/2009 | Lee et al. | 29/889.1 |

FOREIGN PATENT DOCUMENTS

| | | | |
|---|---|---|---|
| DE | 1426778 | B1 | 11/1969 |
| DE | 2016283 | A1 | 10/1970 |
| DE | 102005030516 | A1 | 1/2007 |
| EP | 1939401 | A2 | 7/2008 |
| JP | 2004108290 | A | 4/2004 |

* cited by examiner

*Primary Examiner* — Ninh H Nguyen
(74) *Attorney, Agent, or Firm* — Barlow, Josephs & Holmes, Ltd.

(57) ABSTRACT

The invention relates to a gas turbine blade (10), in particular a compressor blade and/or turbine blade for a turbomachine, wherein the gas turbine blade (10) comprises at least one receptacle (18) for the form-fitting arrangement of a connecting element, by means of which a mechanical load can be introduced into gas turbine blade (10). The invention further relates to a shrouding band segment (16) for arrangement on a gas turbine blade (10), a connection system having a gas turbine blade (10) and having a connecting element, a method for connecting a gas turbine blade (10) to a connecting element, and a rotor for a turbomachine having a rotor disk (12) joined to a blade ring or having a rotor ring joined to a blade ring.

7 Claims, 2 Drawing Sheets

GAS TURBINE BLADE FOR A TURBOMACHINE

The invention relates to a gas turbine blade, in particular a compressor blade and/or turbine blade, for a turbomachine. The invention further relates to a shrouding band segment for arrangement on a gas turbine blade, a connection system of the type named in the preamble of patent claim 10, a method of the type named in the preamble of patent claim 12 for connecting a gas turbine blade to a connecting element, and a rotor of the type indicated in the preamble of patent claim 13 for a turbomachine.

When gas turbine blades and rotor disks or rings are joined during assembly, repair or maintenance, each gas turbine blade must be positioned, moved or twisted opposite adjacent gas turbine blades and in this way can be provided with a pre-stress (so-called pre-twist). Different connecting elements or special tools exist for this purpose, by means of which an appropriate mechanical load can be introduced into the respective gas turbine blade.

Viewed as disadvantages of the known connecting elements are the following points: they are relatively expensive, they do not make possible introducing an optimal load into the gas turbine blade and, in fact, the gas turbine blade can be damaged when the load is introduced.

The problem of the present invention is to make possible an improved possibility for introducing a load into a gas turbine blade.

The problem is solved according to the invention by a gas turbine blade with the features of patent claim 1, a shrouding band segment with the features of patent claim 8 for the arrangement on a gas turbine blade, a connection system with the features of patent claim 10, a method with the features of patent claim 12 for connecting a gas turbine blade to a connecting element, and by a rotor with the features of patent claim 13 for a turbomachine. Advantageous embodiments of the invention are given in the respective subclaims.

An improved possibility for introducing the load into a gas turbine blade is made possible according to the invention in that the gas turbine blade comprises at least one receptacle for the form-fitting arrangement of a connecting element, by means of which a mechanical load can be introduced into the gas turbine blade. In other words, the geometry of the gas turbine blade according to the invention is designed in such a way that the gas turbine blade has a receptacle that forms an integral interface for the form-fitting arrangement of a corresponding connecting element. Due to the integrated receptacle, the gas turbine blade and the connecting element can be engaged with one another in form-fitting manner, so that mechanical loads can be transmitted normally, i.e., at a right angle to the surfaces of the two connection partners. The connecting element, which can be designed, for example, as a tool, pin, mandrel or the like, can be introduced or plugged in very simply in a form-fitting way into the receptacle and without adversely affecting the remaining regions of the gas turbine blade, and if needed, can be detached again from the gas turbine blade in a corresponding simple way. Mechanical loads can be introduced into the gas turbine blade in a simple and flexible manner in this way without damaging the gas turbine blade. Also, the gas turbine blade can be designed in a weight-neutral or even in a weight-reduced manner and this makes possible a short tolerance chain with correspondingly high repeat precision due to the simple construction. The respective geometry of the receptacle, for example, its arrangement, depth of form-fit or edging can be selected as a function of the geometry or of the application purpose of the respective gas turbine blade.

In an advantageous embodiment of the invention, it is provided that a radially inner end region of the gas turbine blade for connecting the gas turbine blade to a rotor disk or to a rotor ring of the turbomachine and/or a radially outer end region of the gas turbine blade is (are) designed as a shrouding band segment. A simple joining of gas turbine blade and rotor disk or rotor ring is made possible by means of this type of radially inner end region. The gas turbine blade can thus be designed as a compressor blade and/or turbine blade. A radially outer end region designed as a shrouding band segment serves to attenuate blade vibrations and is particularly suitable for use of gas turbine blades in a rear turbine stage. In addition, the shrouding band segment reduces the flow around the tip of the gas turbine blade and in this way increases the efficiency of the assigned turbomachine. The shrouding band segment therefore can be basically designed in one part or in multiple parts with the gas turbine blade.

In another advantageous embodiment of the invention, it is provided that the receptacle is formed on the radially outer end region of the gas turbine blade. By forming the receptacle at the radially outer end region of the gas turbine blade, the receptacle is particularly well accessible. In this way, a corresponding connecting element, for example a tool, can be introduced into the receptacle in a correspondingly simple way, in order to load the gas turbine blade with a mechanical load.

A weight optimization of the gas turbine blade is made possible in another embodiment such that it is formed as a hollow blade and comprises at least one hollow space.

In addition, it has been shown as advantageous that the receptacle is formed as a core outlet region of the hollow space. This makes possible a particularly space-saving arrangement of the receptacle without adversely affecting the remaining regions of the gas turbine blade.

Additional advantages result by forming the gas turbine blade in one piece with the receptacle and/or as a cast part. In this way, the gas turbine blade can be produced cost-favorably, simply and in an especially stable way mechanically.

By precision machining or processing at least one surface region of the gas turbine blade, the actual geometry of the gas turbine blade can be completely or at least largely approximated to a theoretical geometry. For example, electrochemical drilling methods (PECM drilling) can be used for the precision processing. Alternatively or additionally, however, further mechanical and/or electrochemical erosion and/or coating methods can be provided for precision processing.

Another aspect of the invention relates to a shrouding band segment for arrangement on a gas turbine blade, in particular a gas turbine blade according to one of the preceding examples of embodiment, whereby an improved possibility for introducing a load into a gas turbine blade is made possible according to the invention in that the shrouding band segment comprises a receptacle for the form-fitting arrangement of a connecting element, by means of which a mechanical load can be introduced into the shrouding band segment. The advantages resulting therefrom can be taken from the preceding descriptions, in which advantageous embodiments of the gas turbine blade are to be viewed as advantageous embodiments of the shrouding band segment and vice versa. The shrouding band segment can be basically designed in one piece with the gas turbine blade or can be produced first as an individual part and subsequently connected to the gas turbine blade.

In an advantageous embodiment of the invention, it is provided that the shrouding band segment has two contact surfaces that are essentially Z-shaped in longitudinal section and disposed opposite one another for the attachment of corresponding contact surfaces of two other shrouding band segments. In this way, adjacent gas turbine blades, which are each provided with a shrouding band segment of this type, can support each other in pairs during the operation of an assigned turbomachine or of a rotor provided with these gas turbine blades, whereby mechanically a particularly stable shroud is created. An undesired bending or twisting of the gas turbine blade during operation is also minimized in this way.

Another aspect of the invention relates to a connection system having a gas turbine blade, in particular a compressor blade and/or turbine blade for a turbomachine, and having a connecting element, by means of which a mechanical load can be introduced into the gas turbine blade, whereby an improved possibility for introducing a load into the gas turbine blade is made possible according to the invention in that the gas turbine blade comprises a receptacle formed to correspond to the connecting element for the form-fitting arrangement of the connecting element. Due to the integrated receptacle, the gas turbine blade and the corresponding connecting element can engage with one another in a form-fitting manner, so that mechanical loads can be transmitted normally, i.e., at a right angle to the surfaces of the two connection partners. Thus a simple, detachable and damage-free loading into and/or unloading out of the gas turbine blade is possible. In this way, for example, prior to connecting it to a shaft of the turbomachine, the gas turbine blade can be provided with a so-called pre-twist very simply and without damage. The gas turbine blade can be provided with a so-called re-twist in a correspondingly simple and damage-free manner within the scope of a repair or overhaul, so that the gas turbine blade can be readjusted. Further advantages can be taken from the preceding descriptions, whereby advantageous embodiments of the gas turbine blade or of the shrouding band segment can be viewed as advantageous embodiments of the connection system and vice versa.

In an advantageous embodiment of the invention, it is provided that the receptacle is formed as a polygonal socket receptacle, especially as a hexagon socket receptacle, and the connecting element is designed as a multi-edge socket wrench, in particular, as an Allen wrench, for loading the gas turbine blade with torque. In this way, a load can be introduced into the gas turbine blade in a particularly simple and cost-favorable way, without requiring a special expensive tool. This also increases the ease of maintenance of the gas turbine blade or a turbomachine provided with it. Thus, the receptacle and the connecting element can be formed alternatively or additionally into an Inbus-like configuration, and basically also as a slotted, Pozidriv, Torx, Tri-Wing, Torq-Set or screwdriver-like bit and socket set.

Another aspect of the invention relates to a method for connecting a gas turbine blade, in particular a compressor blade and/or turbine blade for a turbomachine, to a connecting element, by means of which a mechanical load can be introduced into the gas turbine blade, whereby an improved possibility for introducing a load into the gas turbine blade is made possible according to the invention in that the connecting element is disposed in a form-fitting way in a receptacle of the gas turbine blade designed corresponding to the connecting element. Due to the integrated receptacle, the gas turbine blade and the corresponding connecting element can be arranged relative to one another in a form-fitting manner, so that mechanical loads can be transmitted normally, i.e., at a right angle to the surfaces of the two connection partners. Thus a simple, detachable and damage-free loading into and/or unloading out of the gas turbine blade is possible. Further advantages can be taken from the preceding descriptions, whereby advantageous embodiments of the gas turbine blade, of the shrouding band segment and/or of the connection system can be seen as advantageous embodiments of the method and vice versa.

Another aspect of the invention relates to a rotor for a turbomachine having a rotor disk joined to a blade ring, or having a rotor ring joined to a blade ring, whereby it is provided according to the invention that the blade ring has at least one gas turbine blade that comprises at least one receptacle for the form-fitting arrangement of a connecting element, whereby a mechanical load can be introduced into the gas turbine blade by means of the connecting element. The advantages resulting therefrom can be taken from the preceding descriptions, whereby advantageous embodiments of the gas turbine blade, of the shrouding band segment, of the connection system and/or of the method for connecting a gas turbine blade to a connecting element can be viewed as advantageous embodiments of the rotor and vice versa.

It has thus been shown as advantageous if the rotor is designed as a blisk ("bladed disk") or as a bling ("bladed ring") for a compressor and/or for a turbine of a turbomachine, in particular a thermal gas turbine. A particularly high structural freedom is obtained hereby.

Further features of the invention result from the claims, the embodiment examples as well as on the basis of the drawings. The features and combinations of features named above in the description as well as the features and combinations of features named in the embodiment examples given below are applicable not only in the combination indicated in each case, but also in other combinations or in isolation without departing from the scope of the invention. Here:

Figure 1:
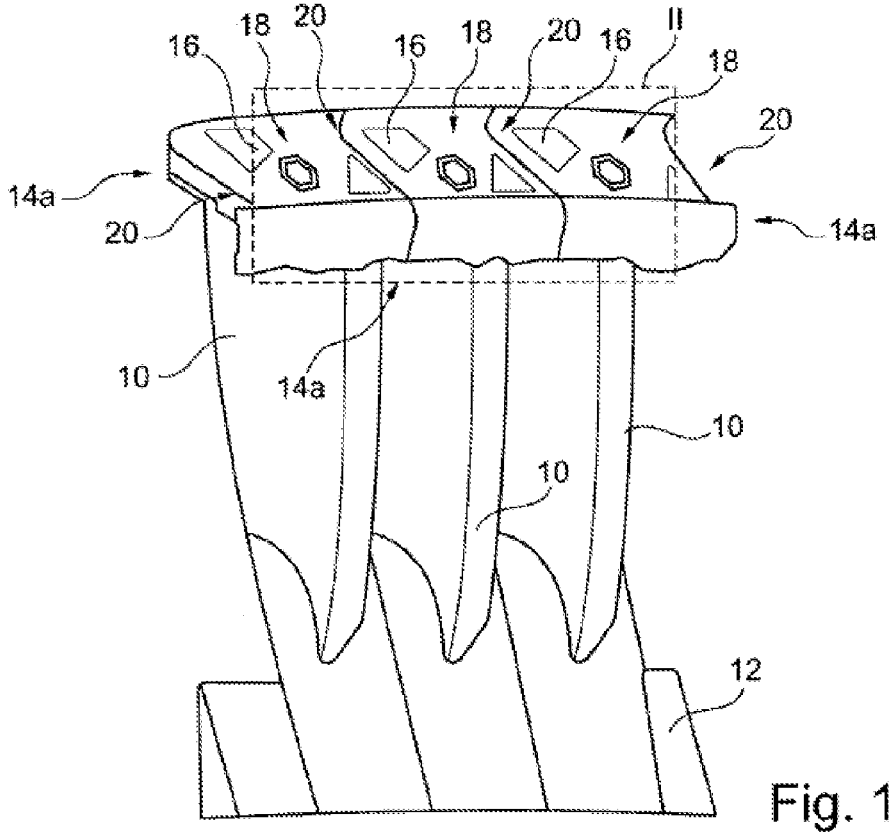
FIG. 1 shows a schematic perspective view of three gas turbine blades according to the invention that are disposed on a rotor disk.

FIG. 1 shows a schematic perspective view of three gas turbine blades 10 according to the invention that are disposed on a rotor disk 12. By completely equipping rotor disk 12 with gas turbine blades 10 and connecting it to these blades, an integrally bladed rotor (so-called blisk or "bladed disk") can be produced for a compressor and/or for a turbine of a turbomachine, in particular a thermal gas turbine. Instead of a rotor disk 12, a rotor ring (not shown) can also be basically used, whereby a so-called bling ("bladed ring") can be produced. A radially outer end region 14*a* is formed as a shrouding band segment 16 for each gas turbine blade 10 (see FIG. 2). Shrouding band segments 16 and their respective gas turbine blades 10 in the present example of embodiment are thus formed in one piece as cast parts. In order to improve the surface geometry, it can be provided that one or more gas turbine blades 10 are precision processed by appropriate post-processing methods, such as PECM drilling. For introducing mechanical loads, each gas turbine blade 10 also comprises an integral receptacle 18, in which a connecting element (not shown) can be arranged in a form-fitting manner. Each receptacle 18 is formed as a hexagon socket receptacle at the radially outer end region 14*a* of gas turbine blades 10 in shrouding band segments 16. At least one Allen-wrench-shaped connecting element can be detachably inserted simply into the respective receptacle 18 in the connecting region in this way in order to load the respective gas turbine blade 10 with torque. In this way, each gas turbine blade 10 can be provided with a so-called pre-twist in a simple manner without causing damage and without the requirement of a special tool.

Figure 2:
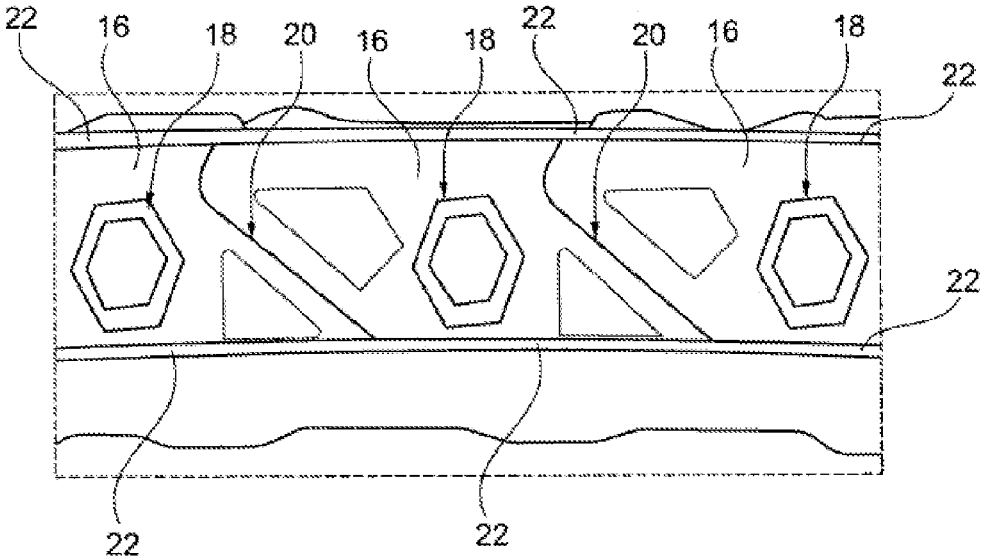
FIG. 2 shows an enlarged view of the detail II shown in FIG. 1.

FIG. 2 shows an enlarged view of the detail II shown in FIG. 1. In addition to shrouding band segments 16 and integral receptacles 18 it can be recognized in particular that each shrouding band segment 16 has two contact surfaces that are disposed opposite to one another and that are essentially Z-shaped in longitudinal section (so-called Z shroud) for attachment to corresponding contact surfaces 20 of adjacent shrouding band segments 16. In addition, it can be recognized that each shrouding band segment 16 comprises two opposite-lying sealing fins 22, which brush against a sealing structure of an assigned turbomachine in a grazing region, in particular during a rotation of rotor 12.

Figure 3:
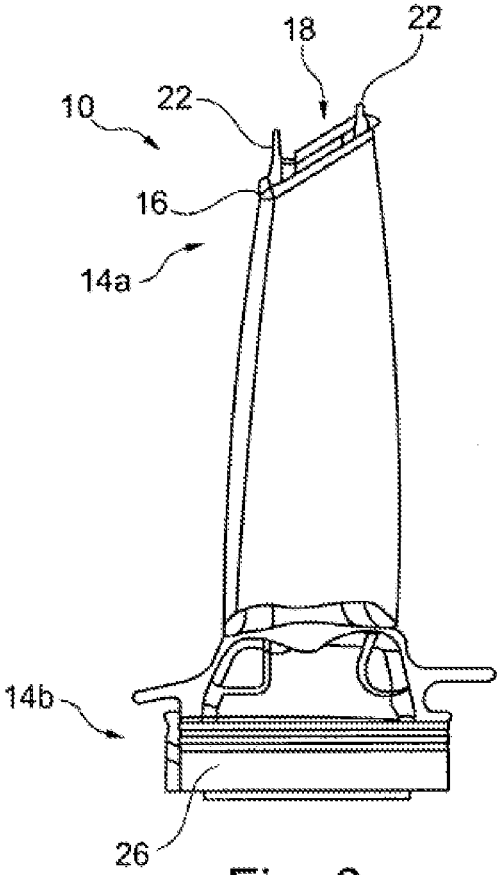
FIG. 3 shows a schematic lateral view of a gas turbine blade shown in FIG. 1.
Figure 4:
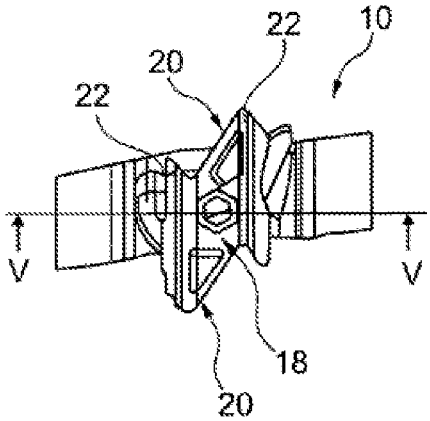
FIG. 4 shows a schematic bottom view of the gas turbine blade shown in FIG. 3.
Figure 5:
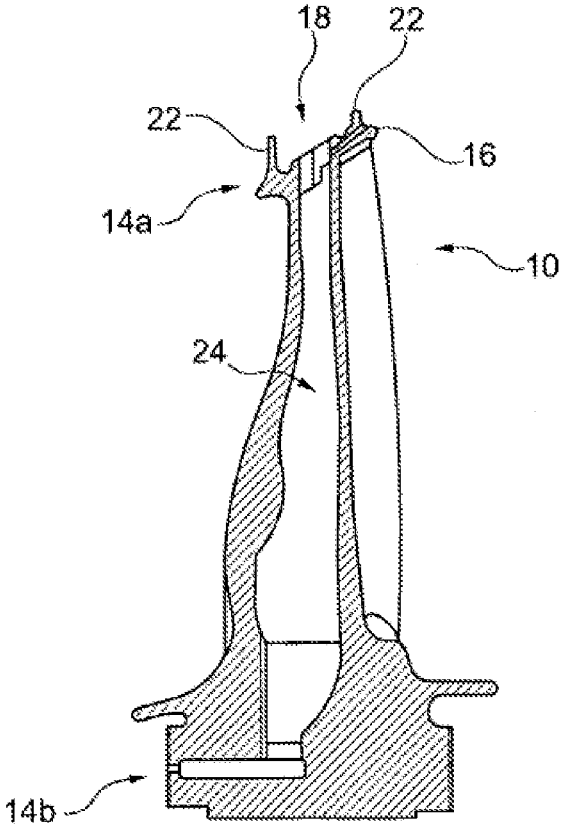
FIG. 5 shows a schematic lateral sectional view of the gas turbine blade along the cutting line V-V shown in FIG. 4.

FIG. 3 shows a schematic lateral view of one of the gas turbine blades 10 shown in FIG. 1 for further clarification. FIG. 3 will be explained in the following together with FIG. 4 and FIG. 5. FIG. 4 shows a schematic bottom view of the gas turbine blade 10 shown in FIG. 3, while FIG. 5 shows a schematic lateral sectional view of gas turbine blade 10 along cutting line V-V shown in FIG. 4. It can be recognized particularly in FIG. 5 that gas turbine blade 10 is presently formed as a hollow blade and comprises at least one hollow space 24. In turn, receptacle 18 is formed as a core outlet region of hollow space 24. In addition, in FIG. 3, a fir-tree structure 26 formed on a radially inner end region 14*b* of the gas turbine blade for joining gas turbine blade 10 to rotor disk 12 can be recognized. The geometry and depth of form-fitting of receptacle 18 can be designed as a function of the shrouding band segment geometry, wherein, for example, the core outlet region of hollow space 24, the arrangement of contact surfaces 20 and/or a geometry of sealing fins 22 can be taken into consideration.

The invention claimed is:

1. A gas turbine blade (10), comprising:

at least one receiver (18) for the form-closing arrangement of a connecting element, by means of which a mechanical load can be introduced into the gas turbine blade (10), wherein the gas turbine blade (10) is formed as a hollow blade and comprises at least one hollow space (24), and wherein the receiver (18) is formed as a core outlet region of the hollow space (24), wherein the receiver (18) is configured in order to receive the connecting element, configured as a tool, pin or mandrel, for form-closing insertion and/or plugging-in into the receiver (18) and loading the gas turbine blade with torque.

2. The gas turbine blade (10) according to claim 1, wherein a radially inner end region (14*b*) of the gas turbine blade (10) is formed for the connection of the gas turbine blade (10) to a rotor disk (12) or a rotor ring of the turbomachine, and/or a radially outer end region (14*a*) of the gas turbine blade (10) is formed as a shroud-band segment (16).

3. The gas turbine blade (10) according to claim 1, wherein the receiver (18) is formed on the radially outer end region (14*a*) of the gas turbine blade (10).

4. The gas turbine blade (10) according to claim 1, wherein the blade is formed in one piece with the receiver (18) and/or as a cast portion.

5. The gas turbine blade (10) according to claim 1, wherein at least one surface region of the gas turbine blade (10) is finely machined.

6. The gas turbine blade (10) according to claim 1, wherein the receiver is formed as a polygonal receiver, and the connecting element is configured as a multi-edge socket wrench.

7. The gas turbine blade (10) according to claim 6, wherein the receiver is formed as a hexagon receiver.

* * * * *